US006315855B1

(12) United States Patent
Fritschi

(10) Patent No.: US 6,315,855 B1
(45) Date of Patent: Nov. 13, 2001

(54) PROCESS FOR IDENTIFYING OBJECTS

(75) Inventor: Markus Fritschi, Teufen (CH)

(73) Assignee: Autotec AG (CH)

( * ) Notice: Subject to any disclaimer, the term of this patent is extended or adjusted under 35 U.S.C. 154(b) by 0 days.

(21) Appl. No.: 09/308,279

(22) PCT Filed: Aug. 24, 1998

(86) PCT No.: PCT/CH98/00361

§ 371 Date: Jul. 16, 1999

§ 102(e) Date: Jul. 16, 1999

(87) PCT Pub. No.: WO99/14057

PCT Pub. Date: Mar. 25, 1999

(30) Foreign Application Priority Data

Sep. 15, 1997 (CH) ..... 2169/97

(51) Int. Cl.[7] ..... B32B 31/00

(52) U.S. Cl. ..... 156/270; 156/277; 156/272.8; 156/522; 156/552; 156/DIG. 1; 156/DIG. 2; 156/DIG. 20; 156/DIG. 34; 156/DIG. 36; 156/DIG. 37; 156/DIG. 49

(58) Field of Search ..... 156/522, 277, 156/248, 270, 272.8, 552, 257, 268, 269, DIG. 1, DIG. 2, DIG. 20, DIG. 34, DIG. 36, DIG. 37, DIG. 49

(56) References Cited

U.S. PATENT DOCUMENTS

| | | | | |
|---|---|---|---|---|
| 5,230,205 | * | 7/1993 | Hautemont | 53/485 |
| 5,250,784 | * | 10/1993 | Muller et al. | 219/121.72 |
| 5,772,828 | * | 6/1998 | Parkander | 156/245 |
| 6,083,584 | * | 7/2000 | Smith et al. | 428/35.2 |

FOREIGN PATENT DOCUMENTS

| | | | |
|---|---|---|---|
| 296-13-123-U1 | * | 11/1996 | (DE) . |
| 19544145 | | 5/1997 | (DE) . |
| 0221552 | | 5/1987 | (EP) . |
| 0641575 | | 3/1995 | (EP) . |
| 0727778 | | 8/1996 | (EP) . |
| 0774365 | | 5/1997 | (EP) . |
| 2259888 | | 3/1993 | (GB) . |
| 9506564 | | 3/1995 | (WO) . |

* cited by examiner

*Primary Examiner*—Linda Gray
(74) *Attorney, Agent, or Firm*—Bachman & LaPointe, P.C.

(57) ABSTRACT

A process for marking compact discs with identfication including attaching a printed we to compact discs supported on a conveyor and then cutting the compact discs from the web along the edges of the compact discs.

10 Claims, 1 Drawing Sheet

PROCESS FOR IDENTIFYING OBJECTS

BACKGROUND OF THE INVENTION

Figure 1:
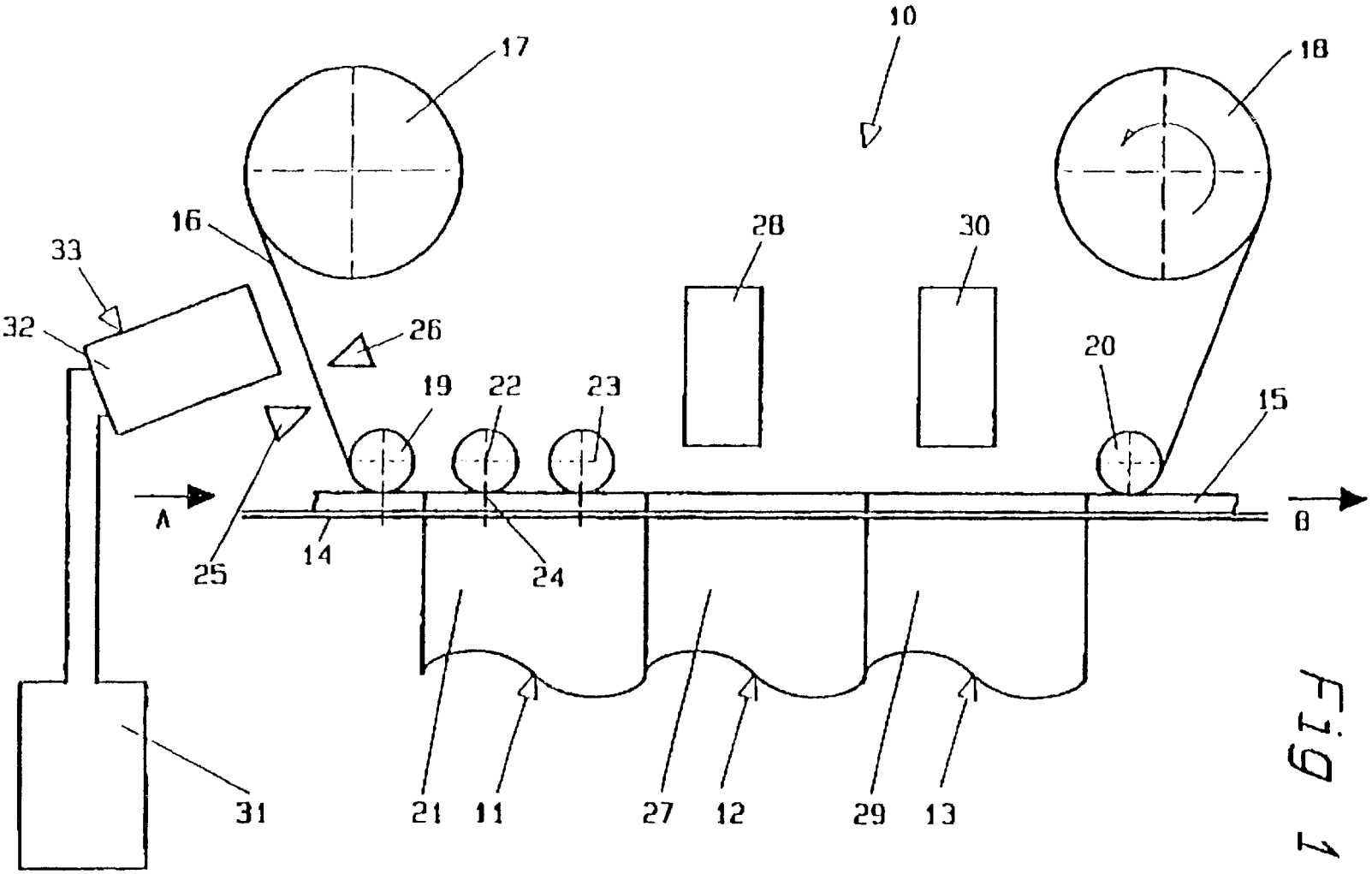

The invention concerns a process for identifying objects, in particular objects of a flat configuration such as Compact Disks (CDs) or the like information carriers.

Various processes which are covered by the generic term of 'printing' such as for example offset, screen and tampon printing processes, have proved successful for identifying objects of the above-mentioned kind. The processes have attained a high technical level but basically they are only economic for long print runs. Apart from the fact that the known processes require the provision of special auxiliary means such as offset plates, screens of printing blocks, the respective number of which multiplies in accordance with the multi-color nature of a print image, it is a change in subject (change in the print theme in terms of word and/or image) which entails conversion times that are not insignificant on expensive printing machines. With that background in mind, the reasons why the known processes are 'not economic' for low-number print runs will be appreciated. The reference to not economic here means that a printing operation with a low number in the print run is markedly more expensive than the same printing operation with a high number of copies and thus the costs of printing or identification are relatively high in comparison with the costs of an object to be printed upon.

In recent times, in regard to certain consumer items, and CDs are a particularly outstanding example in this respect, a changed consumer behavior has occurred, insofar as relatively small order quantities of ordered, individually identified articles are gaining ground, with this being combined with forms of identification which are becoming ever increasingly demanding in terms of printing procedure. As a result the cost problem of short print runs is increasingly moving into the foreground, in which respect the known, that is to say conventional processes, by virtue of their technical perfecting, leave only little space to improve the economy in regard to printing on relatively small order quantities.

SUMMARY OF THE INVENTION

On the basis thereof the inventor set himself the object of providing a process for identifying even relatively small amounts of items, which avoids the disadvantages of the conventional processes.

To identify objects such as for example CDs, the invention moves away from the conventional printing process. For the above-specified purposes the invention involves digital preparation of an original or pattern (hereinafter referred to as images), laser technology for transferring digitally prepared images on to a foil or sheet, lining or laminating technology and laser technology for cutting and possibly welding operations.

An apparatus for carrying out the process according to the invention is inexpensive in comparison with the printing mechanisms of the conventional processes and can be operated at high production speeds. It is particularly advantageous that a change in image can be implemented without interruption, that is to say in seamless mutual succession, so that the process according to the invention is equally well suitable for large print runs and for short print runs.

BRIEF DESCRIPTIONS OF THE DRAWINGS

Further advantageous, features and details of the invention will be apparent from the following description of a preferred embodiment of the process in conjunction with an apparatus for carrying out the process, in which:

FIG. 1 is a view in diagrammatic form of an apparatus for carrying out the process.

DETAILED DESCRIPTION OF THE DRAWINGS

Referring to FIG. 1 the apparatus 10 for carrying out the process according to the invention includes a coating station 11 (the term coating is used to denote layering or laminating), a cutting station 12 and a welding station 13. A conveyor device 14, for example a circulating conveyor belt 14, conveys articles 15 to be identified, for example CDs 15, from the side A, preferably in condition of bearing against each other, to side B, in a cyclically controlled procedure, by way of the coating device 11, the cutting station 12 and the welding station 13, with CDs 15 being applied at A and removed at B. A transparent foil or sheet 16 of plastic material (preferably polyethylene) suitable for the application of identifications such as texts or image or graphic representations passes over one side of the CDs 15 which lie flat on the belt 14, more specifically in the same cyclically controlled mode and synchronously with the conveyor belt 14. The sheet 16 which comes from a supply roll 17 and is wound onto a take-up roll 18 is drawn from the former by way of the coating station 11, the cutting station 12 and the welding station 13, receiving the CDs 15 between the conveyor belt 14 and the sheet 16, in the same cycle relationship and synchronously with respect to the conveyor belt 14. References 19 and 20 denote two deflection rollers, the purpose of which is to orient the sheet 16 and cause it to run in parallel relationship with the conveyor belt 14 spaced therefrom by the thickness of a CD 15. The deflection rollers 19, 20 can be designed to be vertically adjustable in order to adapt the spacing between the conveyor belt 14 and the sheet 16 to CDs 15 of different thickness. The coating station includes a support 21 and for example two pressure rollers 22, 23. The conveyor belt 14 with the CD 15 lying thereon and the sheet 16 in turn lying thereon pass through the roll gap formed between the support 21 and the pressure rollers 22 and 23 respectively, the purpose of the pressure rollers being to produce an intimate join under pressure between the sheet 16 and the surface which faces theretowards of the CD 15. Reference 25 denotes a device between the supply roll 16 and the deflection roller 19, with which a connecting means or agent such as adhesive can be applied to the side of the sheet 16 which is intended to come into contact with and be connected to the surface disposed in opposite relationship thereto of the CD 15. It is also possible to provide, along the same section, a heating and/or cooling device 26 for acting on the sheet 16, if for example particular temperatures in respect of the sheet 16 are to be caused to occur, on passing into the roll gap 24. The cutting station 12 includes a supporting arrangement 27. Like the support 21, passing over the supporting arrangement 27 is the conveyor belt 14 with the CD 15 carried thereon, with the sheet 16 applied thereto, prior to the cutting operation, in band form. Disposed above the supporting arrangement 27 is a cutting device 28 which separates the CD 15 from the sheet 16 by cutting it out of same, while further being held on the conveyor belt. Preferably the cutting device 28 is a cutting device which effects the cutting operation by means of laser beams. In that case, a beam can cut the CD 15 out of the sheet 16 along the outer periphery of the CD, while a beam can cut along the inner periphery of the hole in the CD. The welding station 13 which follows the cutting station 12 has a supporting arrangement 29 and a welding device 30 which is arranged at a spacing thereabove; the conveyor belt 14 with CDs 15 held thereon, with sheet 16, pass through the spacing between the welding device 30 and the support arrangement 29. At this station, the coated CDs 15 are cut out of the sheet 16, as already stated above. The welding device 30, preferably a welding device 30 which operates with laser beams is to perform the function, insofar as is considered desirable for example in regard to the peeling-off resistance of the sheet 16 as a coating, of welding the latter preferably in strip form along the outer periphery of the CD 15 and/or the inner periphery of the hole therein, to the surface of the CD 15. For that purpose one beam can pass along the outer periphery and one beam can pass along the inner periphery. After the welding operation has been effected the sheet 16 is wound on to the take-up roll 18 while the coated and possibly welded CD is removed downstream of the deflection roller 20 from the conveyor apparatus 14.

The coating station 11, the cutting station 12, the welding station 13 and removal of the 'used' sheet 16 downstream of the welding station 13 are illustrated in succession in the aboveoutlined apparatus 10 for carrying out the process according to the invention. The apparatus however is not limited thereto. In principle it is possible, in the foregoing sequence, for the welding station 13 to be arranged upstream of the cutting station 12. If the cutting station 12 and the welding station 13 are kept separate, when using the sequence of the cutting station 12 and then the welding station 13, it would be possible for the sheet 16 which has become the 'used' sheet after the coated CDs 15 have been separated off by being cut out of same, to be deflected towards a take-up roll 18 between the cutting station 12 and the welding station 13. It would also be possible for the cutting station 12 and the welding station 13 to be combined to constitute a processing station at which for example laser beams are used to effect the CD-separating operation, that is to say cutting them, and then effecting the welding operation as described above, in order thereafter to remove the 'used' sheet 16.

Reference 31 denotes an electronically operating data acquisition and processing apparatus which is operatively connected to a device 32 which can apply to the foil or sheet 16 data or signals received from the processing apparatus 31, in readable form, that is to say as letters or graphics. Data acquisition and processing apparatuses which acquire inputted letters, digits, graphic representations, images and the like and convert them into electronic signals are known. Also known are devices 32, for example laser printers, hereinafter referred to as printers 32 for the sake of brevity, which cause signals received from the data acquisition and processing apparatuses to become visible again on another carrier, for example the sheet 16, in the form of images or script. The printer is arranged between the supply roll 17 and the coating station 11 to act on the side of the sheet 16 which is brought into contact with the surface of the CD 15 (referred to hereinafter as the underneath surface). In that respect the identification (image, script etc.) is to be so applied to the underneath surface by means of the printer 32 that after coating the identification on the underneath surface of the sheet 16 is readable from the surface in opposite relationship thereto, in a normal view. The arrangement of the printer 32 between the supply roll 17 and the coating station 11 is referred to as the copier station 33.

The process according to the invention is characterised by the following process steps. Firstly at the copier station 33 an identification is applied to the underside of a sheet 16 which stops during the identification-application operation. After conclusion of the identification-application operation by means of the printer 32 and the sheet 16 moves in the form of a strip or sheet web to the coating station 11 in which the sheet web is so connected to the CD 15 that the identification coincides with the location intended for same on the surface of the CD 15 and the underside of the sheet 16 is connected to the surface of the CD 15, which carries the coating. After the connection has been made (passing through the coating station 11) the CD 15 with strip applied thereto passes into the cutting station 12 in which it comes to a halt in order to be cut out of the sheet web 16 by means of the cutting device 28, that is to say to be separated off into a single CD. After conclusion of the CD-separation operation in the cutting station 12 the coated and separated CD 15 passes into the welding station 13, again comes to a halt there in order if appropriate to effect edge welding operations in that station. While the coating operation is a run-through process step (sheet 16 passes through the coating station 11), the identification operation (copier station 33), the separation operation (cutting station 12) and the welding operation (welding station 13) are stopped-state process steps (sheet with CD 15 and conveyor belt 14 are stationary), while the stopped-state process step which is of the longest duration determines the time for the three stopped-state process steps which take place synchronously.

What is claimed is:

1. A process for marking objects with identification comprising the steps of:

(a) providing a sheet web;

(b) providing a conveyor supporting compact discs to be marked with identification;

(c) providing a copier station, a cooling station and a cutting station;

(d) advancing the sheet web step by step to the copier station, thereafter the coating station and thereafter the cutting station;

(e) advancing the conveyor with the objects step by step to the coating station, and thereafter the cutting station in synchronism with the advancing sheet web;

(f) stopping the sheet web at the copying station and thereafter applying to the sheet web the identification for marking the objects;

(g) stopping the sheet web with identification and the conveyor with-the-objects at the coating station;

(h) contacting and connecting the sheet web with the identification with the objects at the coating station; and (i) advancing the sheet web and conveyor with the objects, in synchronism to the cutting station and cutting the sheet web at the edges of the compact discs to mark the discs.

2. A process as set forth in claim 1, wherein the copier station is operatively connected to a data acquisition and processing apparatus which supplies the copier station with digitised signals corresponding to the identification.

3. A process as set forth in claim 1, wherein at the coating station the sheet web is connected with its underside to a surface of the objects.

4. A process as set forth in claim 3, wherein the connection is made by means of an adhesive.

5. A process as set forth in claim 4, wherein the connection is effected by the application of pressure.

6. A process as set forth in claim 4, wherein the connection is made by means of heat and pressure.

7. A process as set forth in claim 1, wherein the sheet web is polyethylene.

8. A process as set forth in claim 1, including a welding station wherein downstream of the cutting station the sheet web is welded at the edges to the objects.

9. A process as set forth in claim 1, wherein the cutting is effected by means of laser cutting.

10. A process as set forth in claim 8, wherein the welding is effected by means of a laser beam.

* * * * *